US009175464B2

(12) United States Patent
Meyers

(10) Patent No.: US 9,175,464 B2
(45) Date of Patent: Nov. 3, 2015

(54) FLOOR DRAIN

(76) Inventor: Lawrence G. Meyers, Layton, UT (US)

( * ) Notice: Subject to any disclaimer, the term of this patent is extended or adjusted under 35 U.S.C. 154(b) by 1197 days.

(21) Appl. No.: 12/772,220

(22) Filed: May 2, 2010

(65) Prior Publication Data

US 2010/0288685 A1 Nov. 18, 2010

Related U.S. Application Data

(63) Continuation-in-part of application No. 12/046,352, filed on Mar. 11, 2008, now abandoned, which is a continuation-in-part of application No. 11/716,851, filed on Mar. 12, 2007, now abandoned.

(60) Provisional application No. 60/781,512, filed on Mar. 10, 2006.

(51) Int. Cl.
*A47K 1/00* (2006.01)
*E03F 5/04* (2006.01)

(52) U.S. Cl.
CPC ..... *E03F 5/0408* (2013.01)

(58) Field of Classification Search
CPC ..... E03F 1/00
USPC ..... 4/613, 290, 404; 210/163–164
See application file for complete search history.

(56) References Cited

U.S. PATENT DOCUMENTS

| | | | |
|---|---|---|---|
| 855,017 | A | 5/1907 | O'Brien |
| 889,051 | A | 5/1908 | Schodde |
| 1,127,246 | A | 2/1915 | Hirshstein |
| 1,143,174 | A | 6/1915 | Comstock |
| 1,189,742 | A | 7/1916 | Sanders |
| 1,469,303 | A | 10/1923 | Hess |
| 1,669,586 | A | 5/1928 | Boosey |
| 1,749,878 | A | 3/1930 | Fleming |
| 1,792,345 | A | 2/1931 | Williams |
| 1,830,065 | A | 11/1931 | Luff |
| 2,095,024 | A | 10/1937 | Boosey |
| 2,281,448 | A | 4/1942 | Mathey |
| 2,394,964 | A | 2/1946 | Dick |
| 2,484,240 | A | 10/1949 | Morthland |
| 2,550,402 | A | 4/1951 | Boosey |
| 2,777,532 | A | 1/1957 | Sisk |

(Continued)

OTHER PUBLICATIONS

International Search Report for PCT/US2008/056731 mailed Jul. 17, 2008.

(Continued)

*Primary Examiner* — Lori Baker
(74) *Attorney, Agent, or Firm* — Workman Nydegger

(57) ABSTRACT

A floor drain system includes a generally rectangular drain grate having a plurality of drain apertures, and a drain body, having a circular lower portion defining an outlet and configured to mate with an underdrain structure, and an upper portion defining an inlet configured to receive the drain grate in a frictional fit. The drain body includes an integral grout rim surrounding the inlet, having a knife-tapered top edge, configured to reduce the visibility of the grout rim between the surrounding material and the grate. The drain body further includes an undercut rim around an outer perimeter of the inlet, the undercut rim having a bottom surface angled upward toward the drain body. The drain body can also include dovetail-shaped buttresses extending outward from the drain body, having tapered surfaces angled toward the drain body, thereby to mechanically interlock the drain body with hardened grout therearound.

19 Claims, 14 Drawing Sheets

(56) References Cited

U.S. PATENT DOCUMENTS

| | | | | | |
|---|---|---|---|---|---|
| 2,783,852 | A | | 3/1957 | Sisk | |
| 2,843,209 | A | | 7/1958 | Degen | |
| 2,859,452 | A | | 11/1958 | Seewack | |
| 2,898,129 | A | * | 8/1959 | Sisk | 285/42 |
| 2,981,333 | A | | 4/1961 | Miller | |
| 3,037,631 | A | | 6/1962 | Drehmann | |
| 3,040,895 | A | * | 6/1962 | Sisk | 210/164 |
| 3,075,203 | A | | 1/1963 | Stafford | |
| 3,121,682 | A | | 2/1964 | Alberico | |
| 3,246,582 | A | * | 4/1966 | Wade et al. | 210/165 |
| 3,268,920 | A | | 8/1966 | Beer | |
| 3,742,524 | A | | 7/1973 | Ballentine | |
| 3,959,831 | A | | 6/1976 | Hendricks | |
| 4,032,455 | A | | 6/1977 | Kale | |
| 4,067,072 | A | | 1/1978 | Izzi | |
| 4,146,939 | A | | 4/1979 | Izzi | |
| 4,150,009 | A | | 4/1979 | Milenius | |
| 4,199,827 | A | | 4/1980 | Tuleja | |
| 4,307,476 | A | | 12/1981 | Halstad | |
| 4,418,432 | A | | 12/1983 | Vidal | |
| RE31,561 | E | | 4/1984 | Thompson | |
| 4,505,814 | A | | 3/1985 | Marshall | |
| 4,739,524 | A | | 4/1988 | Burd | |
| 4,845,914 | A | | 7/1989 | Burd | |
| 4,910,811 | A | | 3/1990 | Izzi | |
| 5,003,642 | A | | 4/1991 | Robb | |
| 5,022,430 | A | | 6/1991 | Degooyer | |
| 5,117,862 | A | | 6/1992 | Molligan | |
| 5,130,016 | A | | 7/1992 | Gavin | |
| 5,137,314 | A | * | 8/1992 | Gunter | 294/15 |
| 5,216,767 | A | | 6/1993 | Elmore | |
| 5,293,724 | A | | 3/1994 | Cornwall | |
| 5,299,836 | A | | 4/1994 | Woods | |
| 5,372,715 | A | | 12/1994 | Maggard | |
| 5,511,904 | A | | 4/1996 | Van Egmond | |
| 5,656,176 | A | | 8/1997 | Scott | |
| D421,295 | S | | 2/2000 | Barnett | |
| 6,088,842 | A | | 7/2000 | Barnett | |
| 6,173,455 | B1 | | 1/2001 | Nordstrom | |
| 6,175,971 | B1 | | 1/2001 | O'Neill | |
| 6,192,532 | B1 | | 2/2001 | Sesser | |
| 6,381,775 | B1 | | 5/2002 | Sondrup | |
| 6,553,583 | B1 | | 4/2003 | Pan | |
| 6,877,471 | B1 | | 4/2005 | Tanabe | |
| 6,890,427 | B2 | | 5/2005 | Self | |
| 7,178,179 | B2 | | 2/2007 | Barnes | |
| 7,178,675 | B2 | | 2/2007 | Votel | |
| 7,442,296 | B2 | | 10/2008 | Chong | |
| 7,472,719 | B2 | | 1/2009 | Dallmer | |
| 7,632,401 | B2 | | 12/2009 | Edelmayer | |
| 7,699,981 | B2 | | 4/2010 | Ledford | |
| 7,725,960 | B2 | | 6/2010 | Markaj | |
| 8,043,497 | B2 | | 10/2011 | Silverstein | |
| 8,146,616 | B2 | | 4/2012 | Dallmer | |
| 2003/0159978 | A1 | | 8/2003 | Self | |
| 2005/0223481 | A1 | | 10/2005 | Giacomi | |
| 2007/0000038 | A1 | | 1/2007 | Jordon | |
| 2007/0209109 | A1 | | 9/2007 | Meyers | |
| 2008/0005835 | A1 | | 1/2008 | Shipley | |
| 2008/0216221 | A1 | | 9/2008 | Markaj | |
| 2008/0271232 | A1 | | 11/2008 | Self | |
| 2008/0277324 | A1 | | 11/2008 | Meyers | |
| 2010/0043136 | A1 | | 2/2010 | Michael | |
| 2010/0235982 | A1 | | 9/2010 | Stimpson | |
| 2010/0320130 | A1 | | 12/2010 | Meyers | |
| 2012/0047643 | A1 | | 3/2012 | Meyers | |

OTHER PUBLICATIONS

U.S. Appl. No. 11/716,851, Apr. 7, 2009, Office Action.
U.S. Appl. No. 11/716,851, Oct. 27, 2009, Final Office Action.
U.S. Appl. No. 12/046,352, Apr. 6, 2009, Office Action.
U.S. Appl. No. 12/046,352, Nov. 2, 2009, Final Office Action.
U.S. Appl. No. 12/862,681, Dec. 6, 2012, Office Action.
U.S. Appl. No. 12/862,689, Jan. 15, 2013, Office Action.
U.S. Appl. No. 12/862,681, Jul. 23, 2013, Office Action.
U.S. Appl. No. 12/862,689, Aug. 14, 2013, Final Office Action.
U.S. Appl. No. 12/862,681, Sep. 18, 2013, Final Office Action.
U.S. Appl. No. 12/862,689, Dec. 4, 2013, Office Action.
U.S. Appl. No. 12/862,689, Jul. 29, 2014, Final Office Action.
U.S. Appl. No. 12/862,689, Dec. 16, 2014, Office Action.

* cited by examiner

FLOOR DRAIN

PRIORITY CLAIM

The present application is a continuation-in-part of U.S. non-provisional patent application Ser. No. 12/046,352, filed Mar. 11, 2008 now abandoned, which is a continuation-in-part of U.S. non-provisional patent application Ser. No. 11/716,851, filed Mar. 12, 2007 now abandoned, which claims priority from U.S. provisional patent application Ser. No. 60/781,512, filed on Mar. 10, 2006, all entitled FLOOR DRAIN.

BACKGROUND

1. Field of the Invention

The present invention relates generally to floor drains for tiled showers and the like. More particularly, the present invention relates to a rectangular floor drain with a flush-fit drain grate and a knife edge rim.

2. Related Art

Floor drains for showers and the like are most commonly circular in shape. Floor drain styles generally fall into two broad categories. The first category is drains that have grates fabricated from thin metals. These can be referred to as "top-mounted" strainers. The thin top-mounted strainers allow these to be set over top of the surrounding finished floor material. Finished flooring materials are grouted or caulked directly to and flush with the body of the drain, which also supports the perimeter of the thin strainer from below. These strainers self-finish, and do not require a surrounding grout rim.

Another common category of drains incorporates grates that are "flush-mounted". These drains may have grates that are substantially thicker than top-mounted strainers. This drain style incorporates a grout rim that surrounds the grate and has an upper surface that is generally coplanar with the top surface of the grate. Flush-mounted drains are typically engineered with a controlled amount of clearance between the grate and the grout rim to allow for removal of the grate. This design also incorporates structure supporting the grate from below. The outer perimeter of the grout rim is bonded to the surrounding finished floor material with tile grout or caulking at installation.

Commonly constructed from stamped stainless steel or brass sheet material, top-mounted grates often incorporate snap features that allow them to be held in place without the use of screws. These may appear to be easy to remove without tools, but are often quite difficult to remove. Commonly available tools, i.e. a screw driver, do not adequately function as a removal tool. Due to their thin cross-sectional thickness, top-mounted drain grates are often not capable of supporting a substantial amount of weight, and are often observed having been deformed as a result. This style is not a good candidate for a square configuration because exposed corners are likely to become a hazard to bare feet. Should the grate become deformed, this problem becomes worse.

Floor drains with flush-mounted grates are commonly available with grout rim features that are formed from the same metal as the grate, or by a portion of the drain body that is allowed to be exposed. Both of these approaches have inherent design problems. Those designs that allow the drain body to be exposed are limited to having an aesthetically incompatible visual element surrounding the grate. The nature of grout rims is that they are a portion of the drain structure that are designed to be bonded into the finished floor installation, and cannot be removed.

There is a growing trend within the plumbing fixtures market to offer consumers a wider selection of metal finish styles and colors. The market is becoming much more design-conscious. Plumbing fixtures are now available in often more delicate patina finishes. Whereas the choices used to be limited to brass and chrome, now colors and finishes such as aged pewter, brushed nickel, oil rubbed bronze, gun metal black, antique copper and others have become popular and widely available.

This greater variety of colors and finishes raises maintenance concerns. Because of the harsh nature of chemicals that are used to remove water deposits, mold and other common conditions, delicate patina surfaces cannot be exposed to such substances without becoming visually altered. This is especially the case for shower floor drains which are in contact with such chemicals for a much longer duration than fixtures mounted to vertical surfaces, for example. Additionally, because of their delicate surface finish, such drains cannot incorporate a matching grout rim that has any kind of delicate surface patina without a substantial risk of damage from maintenance procedures and chemicals. The likelihood that these would exhibit any durability is questionable. Additionally, screws that are frequently used to secure the grate are difficult and time consuming to remove. Moreover, sharp burrs can easily form on brass and stainless screw heads from repeated use, and screws can be dropped and become lost down the drain if care is not taken.

SUMMARY

It has been recognized that it would be advantageous to develop a floor drain having a grate that is simpler to remove and maintain.

It has also been recognized that it would be advantageous to have a floor drain which is easy to set and does not include an unsightly grout rim.

It has also been recognized that it would be advantageous to have a floor drain with a drain grate that is easily removable and can be constructed of a greater variety of materials for allowing a wider range of decorative appearance.

In accordance with one embodiment thereof, the present invention provides a floor drain, including a drain body, a generally rectangular drain grate supported by the drain body and having a plurality of drain openings, and a grout rim supported by the drain body and surrounding the drain grate. The drain body includes a generally rectangular upper portion defining an inlet aperture, and a circular lower portion defining an outlet in fluid communication with the inlet aperture, the lower portion being configured to interconnect to an underdrain structure. The grout rim has an outside surface having interlocking structure configured to interlock with surrounding materials, and a sharply tapered top edge, configured to reduce the visibility of the grout rim between the surrounding material and the grate.

In accordance with another aspect thereof, the invention provides a floor drain, including a drain body, a generally rectangular drain grate supported by the drain body, and a grout rim supported by the drain body and surrounding the drain grate. The drain body includes a generally rectangular upper portion defining an inlet aperture, and a circular lower portion defining an outlet in fluid communication with the inlet aperture, the lower portion being configured to interconnect to an underdrain structure. The drain grate includes a plurality of drain openings and a plurality of downwardly oriented mounting posts configured to insert into receiving holes in the drain body with an interference fit, whereby the drain grate is removably secured to the drain body.

In accordance with yet another aspect thereof, the invention provides a floor drain assembly, including a drain body having an outlet, a generally rectangular drain grate supported by the drain body and having a plurality of drain openings, a grout rim supported by the drain body and surrounding the drain grate, and an underdrain inlet attached to the outlet of the drain body. The drain body includes a generally rectangular upper portion defining an inlet aperture, and a circular lower portion defining an outlet in fluid communication with the inlet aperture, the lower portion having helical threads configured to threadedly interconnect with corresponding helical threads of an underdrain structure, whereby a height of the inlet can be adjusted by rotating the drain body about a central axis.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
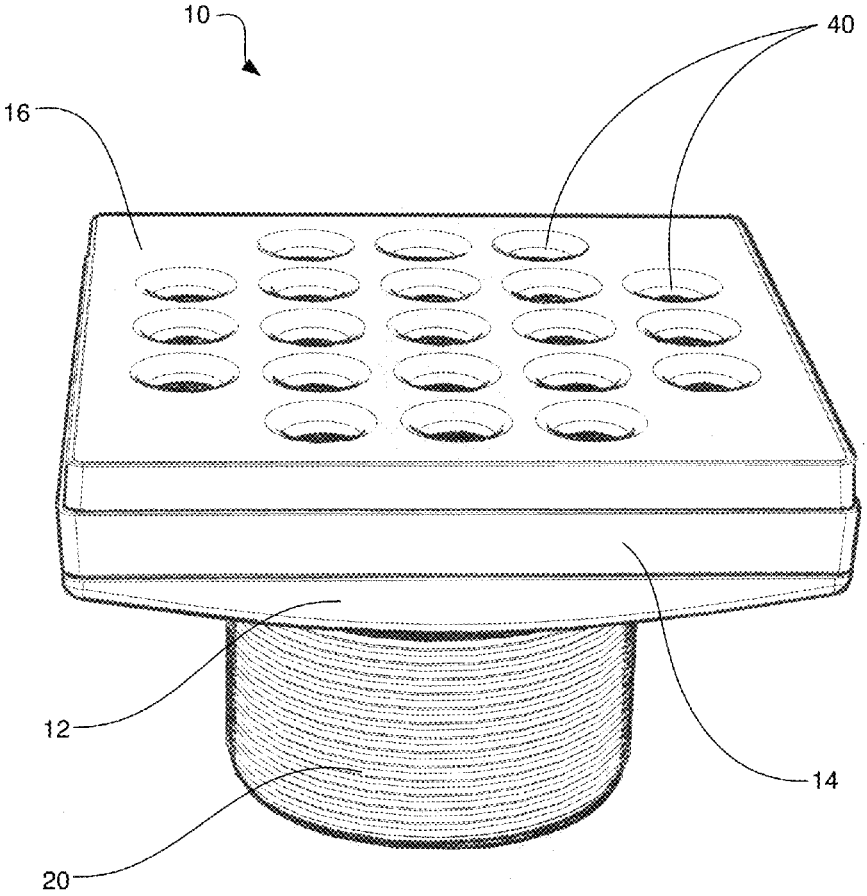
FIG. 1 is a perspective view of one embodiment of a floor drain in accordance with the present invention.
Figure 2:
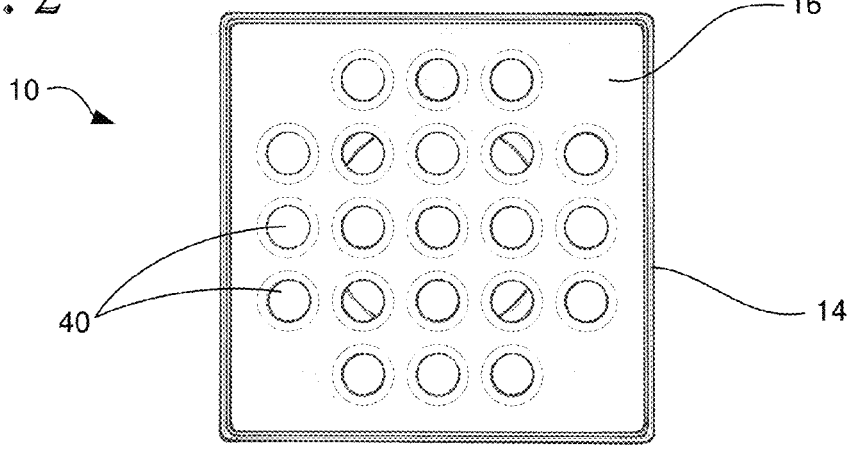
FIG. 2 is a top view of the floor drain of FIG. 1, showing the drain grate.
Figure 3:
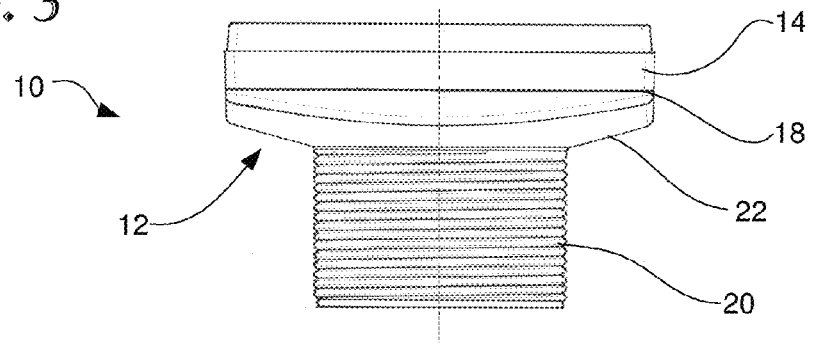
FIG. 3 is a side view of the floor drain of FIG. 1.
Figure 4:
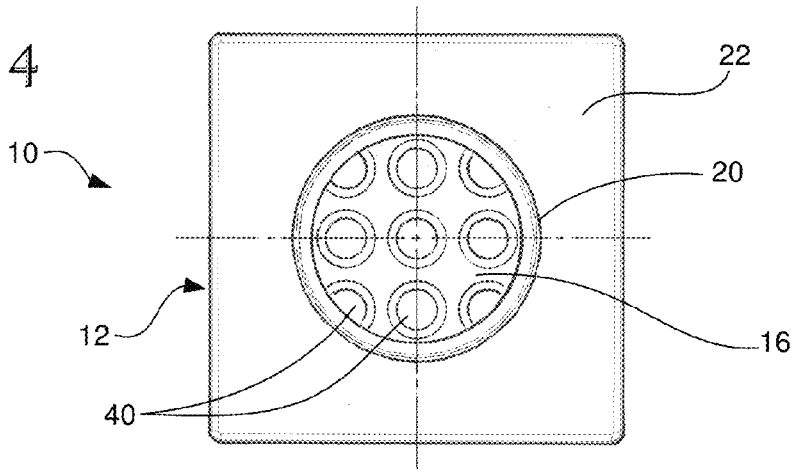
FIG. 4 is a bottom view of the floor drain of FIG. 1.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

To address some of the problems with existing floor drain structures, the inventor has developed an easily removable drain grate that can include a desired delicate finish, surrounded by a minimal grout rim that is nearly invisible to the eye. When cleaning or maintenance is to be performed the grate can be quickly and easily removed to a place where care can be taken to clean it while preserving its designer finish. The design does not use screws to secure the grate, which avoids the difficulty and time required to remove them, and which can drop and become lost down the drain if care is not taken. The design also avoids sharp burrs that can easily form on brass and stainless steel screw heads from repeated use.

One embodiment of a floor drain device in accordance with the present invention is shown in FIGS. 1-6. The drain device 10 comprises three main parts: a drain body 12, a grout rim 14, and a grate 16. The drain body includes an upwardly open square top portion 18, with a downwardly extending circular threaded stem 20, and a tapered transition section 22 therebetween. The drain body as shown is a single integral piece of material, though it will be apparent that the body could also be assembled from multiple pieces. A variety of materials can be used for the drain body, including polymer materials such as ABS, PVC, etc. Other materials can also be used. The drain body can be injection molded, or produced by other methods. While the top portion of the drain body as shown in the figures is square in shape, other shapes can also be used in accordance with the invention, such as rectangular, round, hexagonal, etc.

Figure 5:
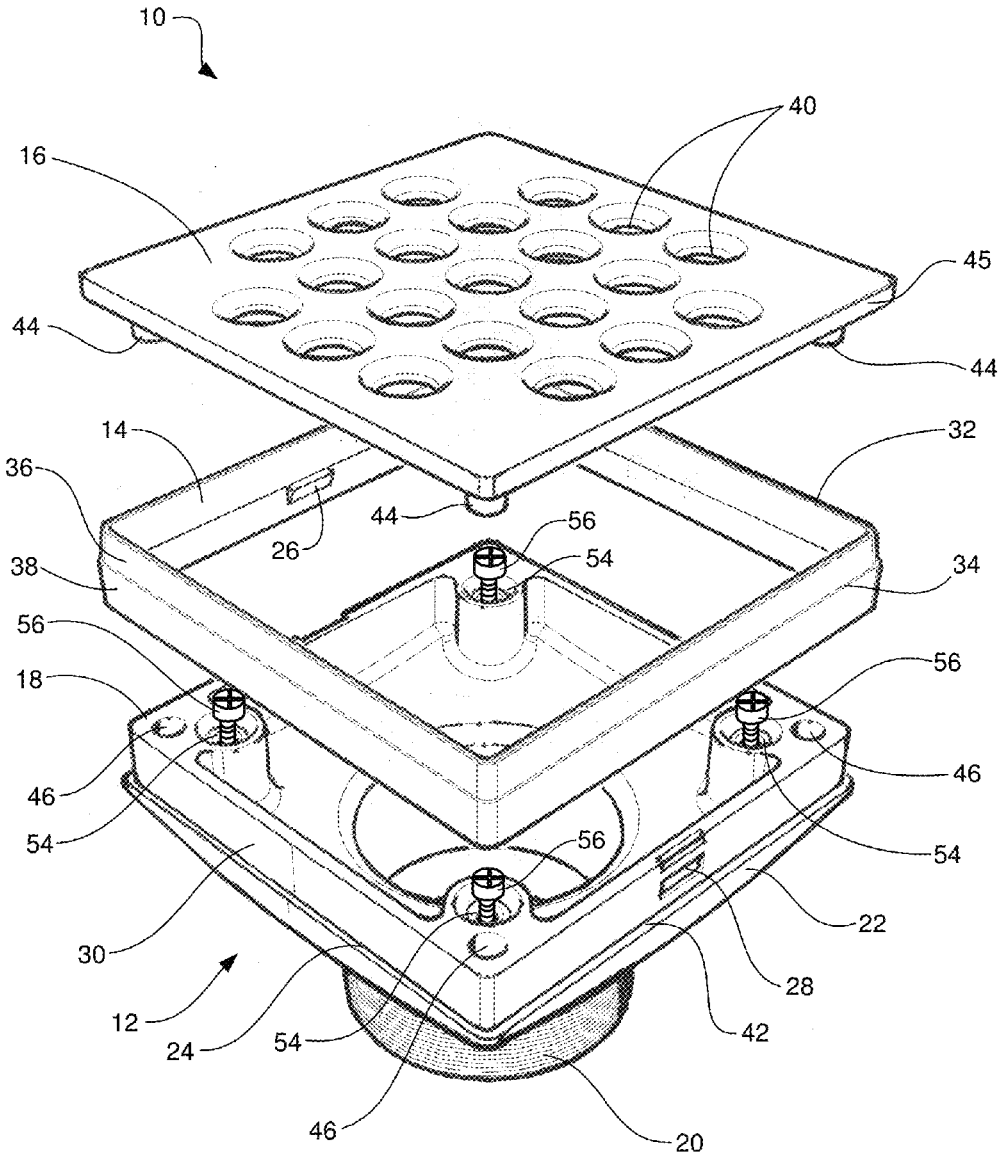
FIG. 5 is an exploded perspective view of the floor drain of FIG. 1, showing the drain grate, grout rim, and drain body.
Figure 6:
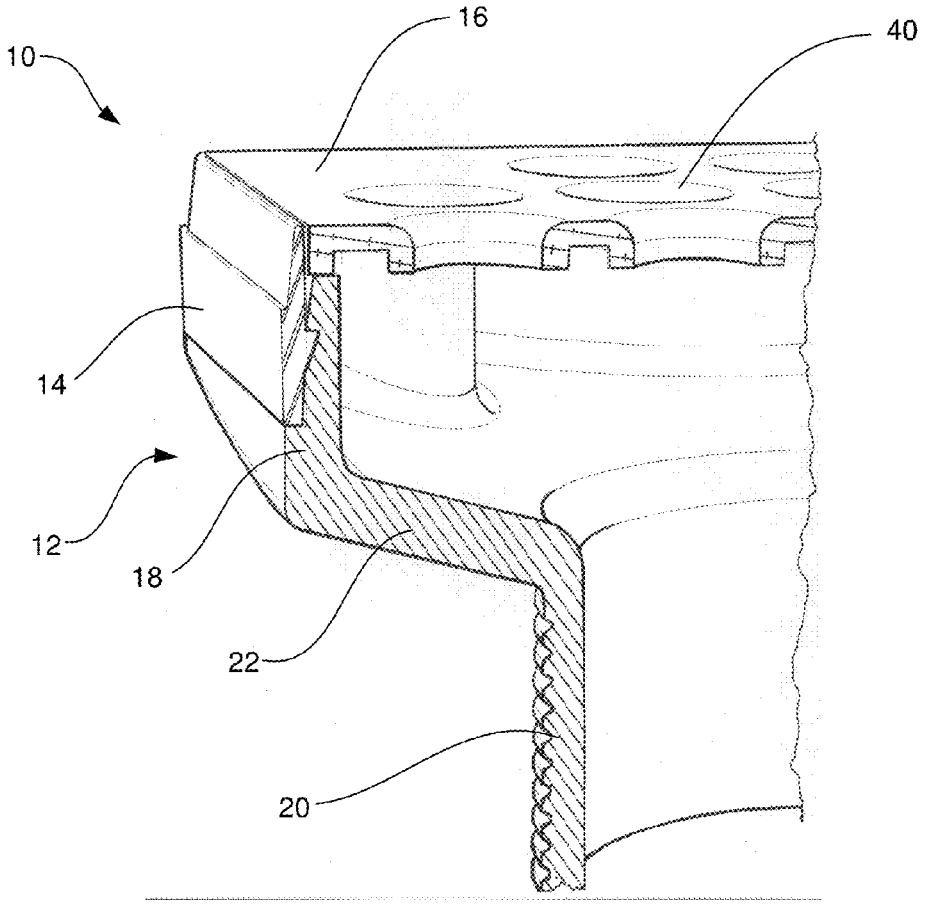
FIG. 6 is a partial cross-sectional perspective view of the assembled floor drain.

The grout rim 14 is supported on a shoulder 24 of the top portion 18 of the drain body 12. The shoulder can be designed to provide three positive points of contact with the grout rim along each side of the drain body. This helps to ensure that the grout rim is level and rests firmly against the shoulder, to compensate for possible irregularities in the line and level of the grout rim that are a result of the casting and trimming process. As shown in FIG. 5, the grout rim can include a wedge-shaped locking tab 26, which interlocks with interlocking notches 28 disposed in the outer rim 30 of the top portion of the drain body. This interlocking configuration allows the grout rim to snap fit onto the top portion of the drain body with a tight, secure fit. The grout rim 14 can be of metal or other suitably strong material, and can be a single integral piece (e.g. a single metal casting), or can be an assembly of multiple pieces. The single piece configuration is believed to have greater strength and to simplify assembly.

The top edge 32 of the grout rim 14 is tapered to a very narrow edge, almost a knife edge, so that when the floor drain is installed with grout packed therearound, the grout rim becomes barely visible. The thickness of the top edge can vary. In one embodiment, the inventor has used a grout rim having a top edge having a thickness of from about 0.01 to 0.04 inches. The thickness of the top edge can also be in the range of about 0.01 to 0.03 inches. Additionally, the top edge can be configured with a radius. In one embodiment, the inventor has provided a radius equal to about half the thickness of the grout rim at top (e.g. about 0.005 inches) on the outside of the top edge (i.e. the side facing away from the inlet). Providing a radius only on the outside edge of the grout rim helps transition from the surrounding grout to the rim, and also maintains a square surface on the inside to match with the drain grate. To facilitate removal of the grout rim from a mold, the sides of the grout rim (both inside and outside) can be tapered at a slight angle of, e.g. 1 to 3 degrees. The outside edge of the drain grate (45 in FIG. 5) can be provided with a corresponding taper to enhance the fit between the grate and the inside face of the grout rim. The grout rim can be of a neutral color, so that it blends into its surroundings and becomes practically unnoticeable.

Figure 7:
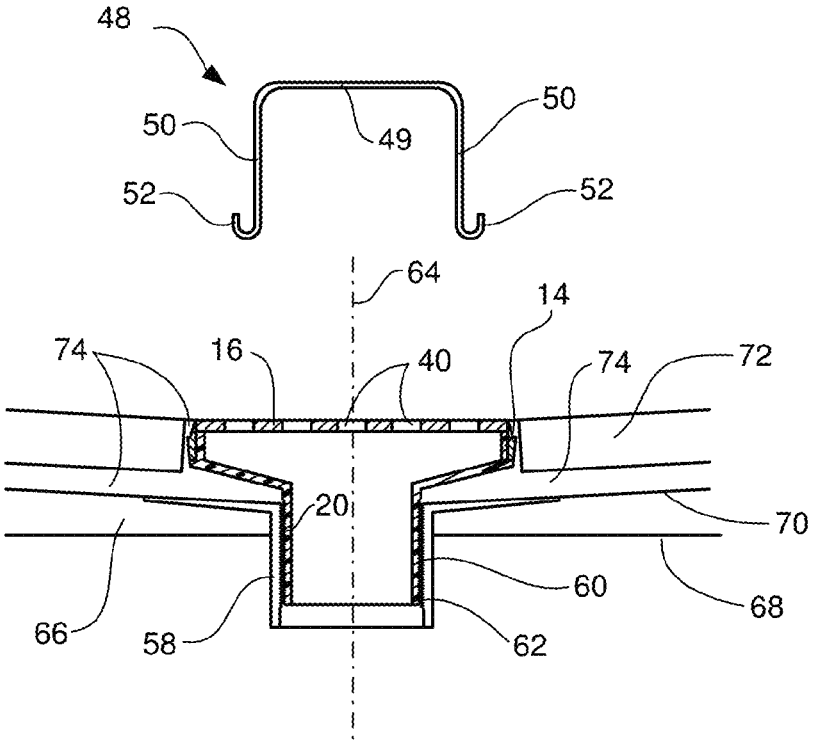
FIG. 7 is a side, cross-sectional view of a complete installation of the floor drain of FIG. 1 in a shower floor assembly, and a drain grate removal tool.

A cross-sectional view of the floor drain installed in a shower or the like is provided in FIG. 7. The outer faces of the grout rim are configured to provide a positive lock with the grout or other material that is packed around the drain, so that the rim is prevented from moving up or down with respect to the surrounding structure. Particularly, the grout rim includes an outside shoulder 34 and an inwardly tapered upper face 36 that interlock with the surrounding material to hold the rim in place and prevent upward movement of the rim relative to the surrounding grout. The grout rim also includes a lower tapered face 38 that helps prevent downward movement of the rim. These features interlock with the material surrounding the drain to hold it in its proper elevational position.

The grout rim 14 has a height that makes it taller than the outer rim 30 of the drain body 12, so that the top edge 32 of the grout rim extends above the top portion 18 of the drain body when the grout rim is installed on the shoulder 24. This upper portion of the grout rim is configured to surround the drain grate 16. The drain grate comprises a substantially planar piece of material with a plurality of drainage holes 40 formed in it. The drain grate can be of metal, such as brass, bronze, zinc, stainless steel, aluminum, or other suitable material. The grate can also be surface treated such as with a coating, plating, or chemical finish to provide a desired color, shine or patina. For example, the inventor has used a nickel plated zinc drain grate. Other platings can also be used, such as chrome and copper. The drain grate is supported by the top edge 42 of the upper portion of the drain body.

Unlike most floor drain devices, the drain grate 16 of this floor drain 10 is not attached with screws or other fasteners, but is removably inserted onto the drain body 12 with an interference fit. Alignment of the grate with the drain body is assisted by the grout rim 14, which surrounds the grate. Additionally, the drain grate includes a plurality of mounting posts 44, in this case one mounting post at each of the four corners, which extend downwardly from the plane of the grate and are configured to insert into corresponding grate mounting holes 46 in the drain body. The grate mounting holes can have a slightly tapering diameter that gradually diminishes in size, so that when the mounting posts are inserted into the mounting holes, they will naturally reach a position at which friction between the posts and the sides of the holes holds the grate structure to the drain body with an interference fit. The mounting posts can also have a mating angle to their outer surfaces to match the taper of the mounting holes. In addition to attaching the grate to the drain body, the mounting posts also align the grate with the drain body and the grout rim, so that the gap surrounding the grate is substantially uniform on all sides.

This interference fit configuration makes it easy to remove the drain grate 16 whenever desired, and avoids the use of small fasteners that can become lost down the drain when removed. Shown in FIG. 7 is one embodiment of a grate removal tool 48 that can be used to remove the grate from the drain assembly. This grate removal tool comprises a stiff, springy wire having a central handle portion 49 and two leg portions 50 that descend from the handle portion, with a hook 52 at the distal end of each leg portion. To remove the grate, the user holds the grate removal tool by the handle portion, and pushes the two hooks downwardly into two of the drainage holes 40 in the grate. When the hooks are pushed into the holes, the spring nature of the grate removal tool causes the free ends of the hook to bear against the underside of the grate. The user can then remove the grate by simply pulling upwardly on the tool.

Figure 9A:
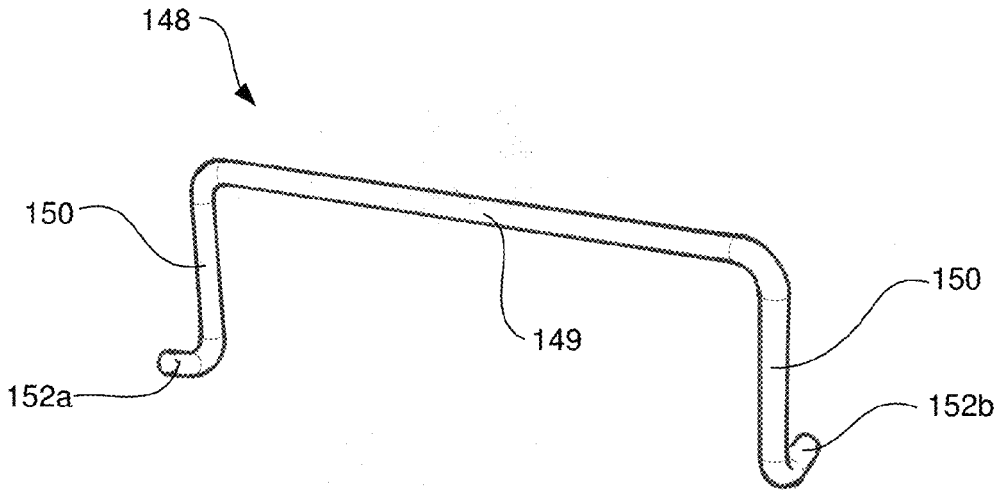
FIGS. 9A and 9B are perspective views of an alternative embodiment of a drain grate removal tool.
Figure 9B:
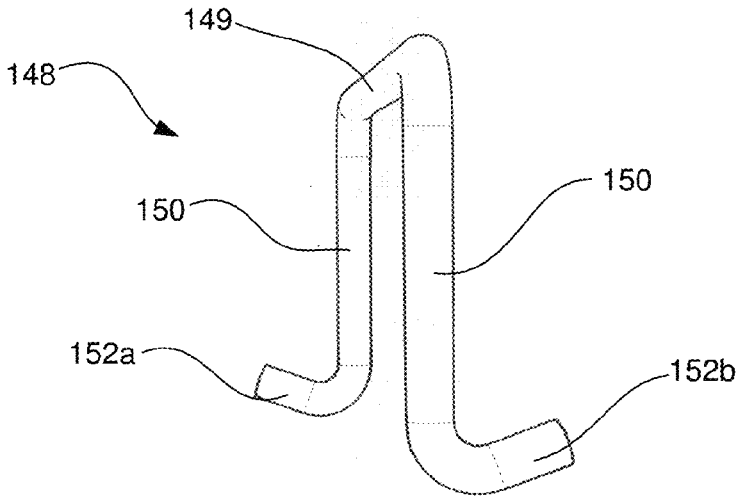

An alternative embodiment of a grate removal tool 148 is shown in FIGS. 9A and 9B. This grate removal tool comprises a wire having a central handle portion 149 and two leg portions 150 that descend from the handle portion, with a hook 152 at the distal end of each leg portion. As can be seen in the figures, the hooks are oriented out of the plane of the removal tool. Further, one hook 152*a* is oriented in one direction, while the other hook 152*b* is oriented in roughly the opposite direction. To remove the grate with this tool, the user holds the grate removal tool by the handle portion, and inserts the two hooks downwardly into two of the drainage holes in the grate using a pivoting motion. That is, a user holds the removal tool at an angle (i.e. not perpendicular) relative to the drain grate to insert one hook into a first hole, then rotates the tool to an opposite angle to insert the second hook into a second hole, essentially weaving the hooks into two of the grate holes. When the hooks are inserted into the holes, the free ends of the hook bear against the underside of the grate, allowing the user to remove the grate by pulling upwardly on the tool.

Easy removal of the grate 16 is advantageous for in many ways. It is helpful for cleaning. For example, harsh abrasive cleansers that are often used to clean a shower floor or other surface around a drain can damage the drain grate. If the grate can be easily removed for cleaning, this can allow a wider variety of more delicate materials or materials with more delicate surface finishes to be used for grates. Easy removal of the grate is also advantageous from a decorative or maintenance standpoint. If one desires to replace a grate with a different color, material or style, for example, or a new grate is needed, this is a simple matter of removing one grate and replacing it with another. Easy removal of the grate is also advantageous in preparation for clearing clogs with a pipe snake or other device, and can also help avoid damage to the material of the grate or its finish from harsh clog dissolving or drain clearing chemicals.

Referring back to FIG. 5, the drain body can also include a group of set screw holes 54 which can be used for inserting a set screw 56 to assist in leveling the grate. When in place, the tops of these screws support the bottom of the grate, and by turning the screw a user can raise or lower the top of the screw to help maintain the level of the grate. This can be desirable where the grate is not exactly flat. It is to be understood that the embodiment shown in FIG. 5 can also be used without the set screws.

Figure 8:
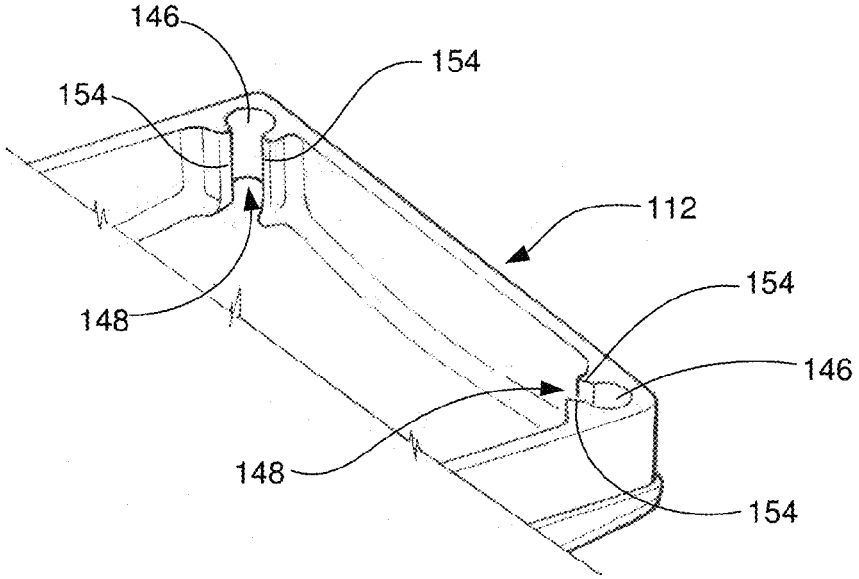
FIG. 8 is a partial perspective view of an alternative embodiment of a drain body of a floor drain assembly in accordance with the present disclosure.

An alternative embodiment of a drain body 112 is shown in FIG. 8. In this embodiment the grate mounting holes 146 (into which the grate mounting posts of the grate insert) each include a relief slot 148 defined by side walls 154. The relief slot can serve at least two functions. First, it increases the flexibility of the grate mounting hole, which can be desirable for the interference fit of the grate mounting posts. If there are slight variations in the relative size or shape of the mounting holes and/or the grate mounting posts (due to manufacturing variations, for example), the increased flexibility of the mounting holes can allow greater tolerance for these variations. Additionally, the relief slots can provide an avenue for promoting removal of debris, such as sand, grout, etc., that might enter the mounting holes during construction or at other times. With a blind hole, debris can become trapped in the hole, and can thus hinder the fit of the drain grate into mounting holes, and can also cause a change in elevation or tilt of the drain grate, potentially exposing sharp edges or causing other undesirable conditions.

The threaded stem 20 of the drain body 12 is configured to screw into an underdrain fixture 58, shown in the cross-sectional view of FIG. 7. This drain structure is typical of showers, but is only representative of the type of structure with which the invention is compatible. The outside threads 60 of the stem intermesh with the inside threads 62 of the underdrain fixture to allow precise adjustment of the height of the top of the floor drain. To raise or lower the top of the floor drain, a user simply rotates the drain structure about its axial centerline 64.

The underdrain fixture 58 is typically attached to a waterproof membrane 66, which has a flat bottom surface 68 that is to be supported on a building subfloor, and a sloped top surface 70 that is configured to promote drainage toward the drain. Finished floor material 72, such as ceramic tile, porcelain, or the like, is affixed to the top surface of the mortar bed using thinset mortar 74 or other suitable material. Once the drain is adjusted to the proper height, the grout is packed in around it to eliminate any voids. Then, when the floor surface material is in place, grout is also packed around the grout rim 14 to provide a secure construction.

Figure 10:
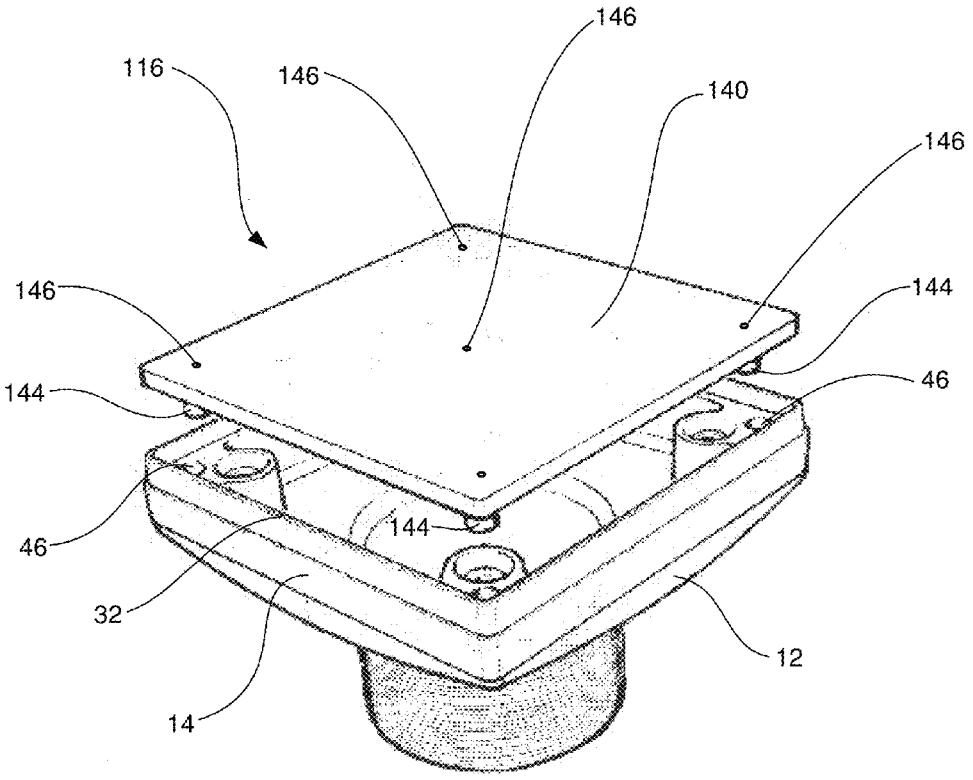
FIG. 10 is a perspective view of a floor drain assembly without a drain grate, showing one embodiment of a cover cap configured for use during installation of a floor drain assembly.

FIG. 10 is a perspective view of an embodiment of a cover cap or plug 116 configured for use during installation of a floor drain assembly in accordance with the present disclosure. The cover cap is configured similar to a drain grate (16 in FIG. 1) and includes mounting posts 144 that are positioned to fit into the mounting holes 46 in the drain body 12 with an interference fit, in a manner similar to the installation of the drain grate (16 in FIG. 5). The cover cap serves several functions. During installation of the drain assembly and construction of the surrounding floor, the cap can be temporarily inserted into the drain inlet opening instead of a drain grate. This protects the drain grate from possible damage during construction. Additionally, because the top surface 140 of the cap does not include any openings, the cover cap prevents sand, grout, or other construction debris from falling into the drain or becoming lodged in the grate mounting holes or other portions of the drain during construction.

Additionally, the cover cap or plug 116 helps maintain the shape and integrity of the grout rim 14 during construction. Because the grout rim tapers to a relatively sharp top edge 32, the grout rim can be quite thin and flexible and susceptible to damage during construction of the surrounding floor. The cover cap can be designed to have a very tight fit with the grout rim (e.g. having a much tighter fit than is intended for the drain grate) so as to provide positive mechanical support of the grout rim during construction, to prevent the rim from being bent, damaged, etc. The cover cap can be made of resilient polymer materials, such as polypropylene, etc. The top of the cover cap can be smooth, so as not to interfere with screeding of the surrounding floor. To remove the cover cap, a user can cut it with a blade and remove it in pieces, or drive a screw into the cap and pull the cap out of the drain body while gripping the screw. Other removal methods can also be employed.

Figure 11:
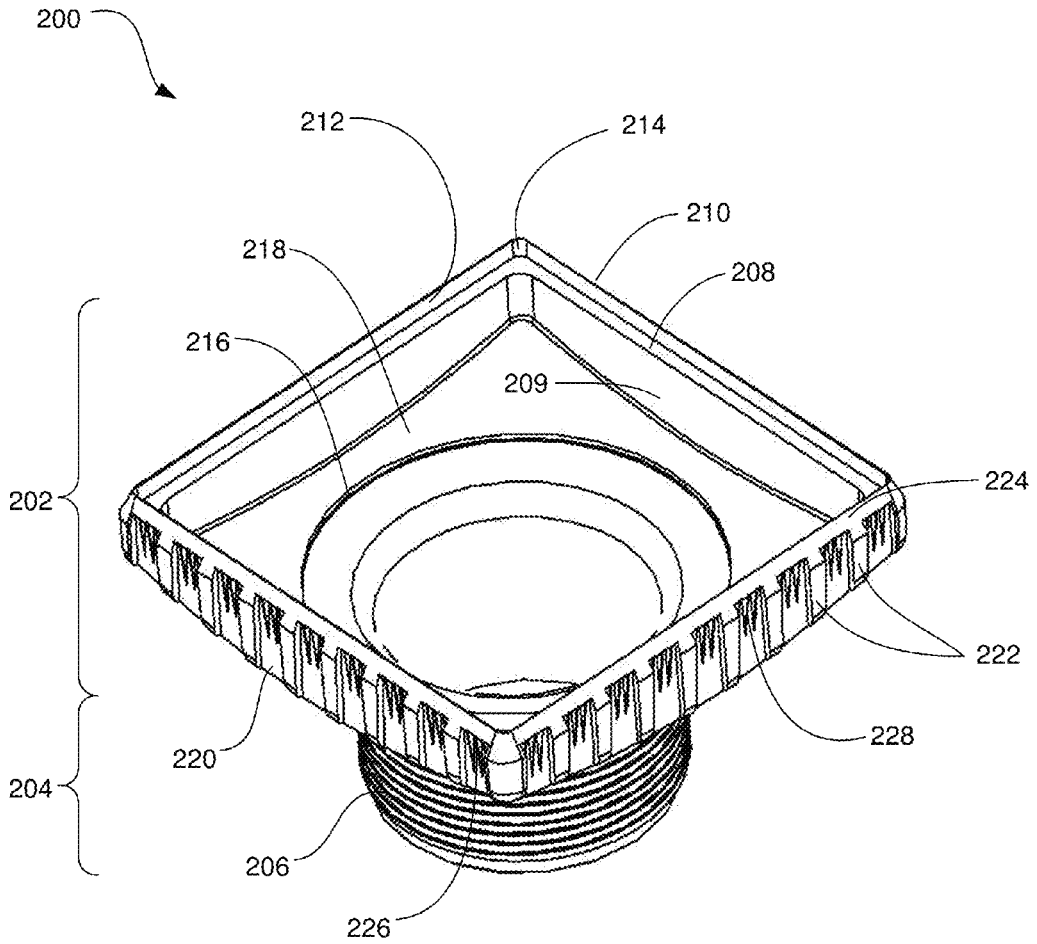
FIG. 11 is a perspective view of another embodiment of a drain body in accordance with the present disclosure.
Figure 12:
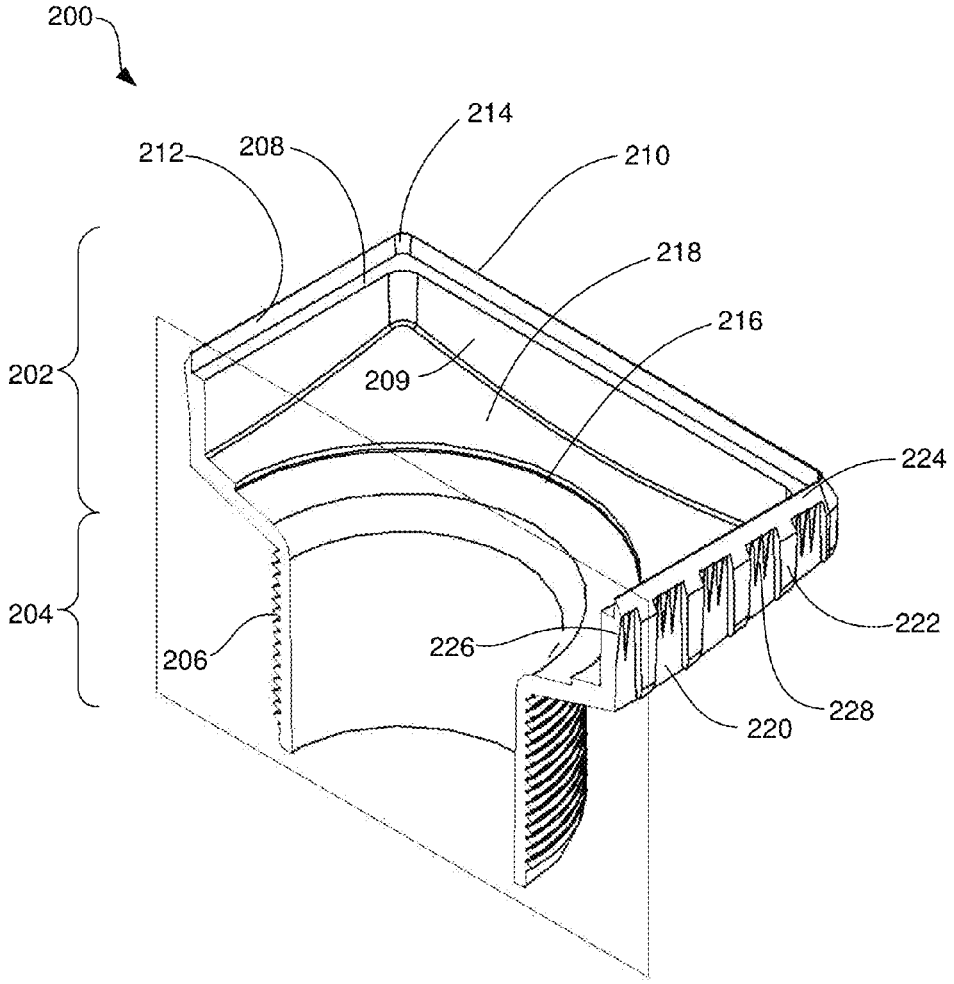
FIG. 12 is a cross-sectional perspective view of the drain body of FIG. 11.

Shown in FIGS. 11 and 12 are perspective and cross-sectional views of another embodiment of a drain body 200 in accordance with the present disclosure. This drain body 200 is a one piece unit, having a generally rectangular upper portion 202 defining an inlet, and a circular lower portion 204 defining an outlet and being configured to mate with an underdrain structure (e.g. like that shown in FIG. 7). As with the embodiments described above, the lower portion of the drain body includes helical threads 206 for connection to the underdrain, allowing the height of the drain inlet to be adjusted by rotating the drain body. The drain body can be of an injection-molded polymer, allowing it to be strong and lightweight.

The inlet portion 202 of the drain body 200 includes a shoulder 208 on its inner perimeter, for supporting a drain grate. Surrounding the shoulder is a knife edge grout rim 210 that is integral with the drain body, rather than being a separate grout rim piece. The inner surface 212 of the grout rim includes 90 degree filleted corners 214. This configuration helps reduce binding of the grate and, because there are no corner posts, allows for a greater selection of grate opening configurations. The drain body can also include a step or recess 216 in the bowl floor 218, which can allow for the inclusion of a hair trap device (not shown).

Figure 16:
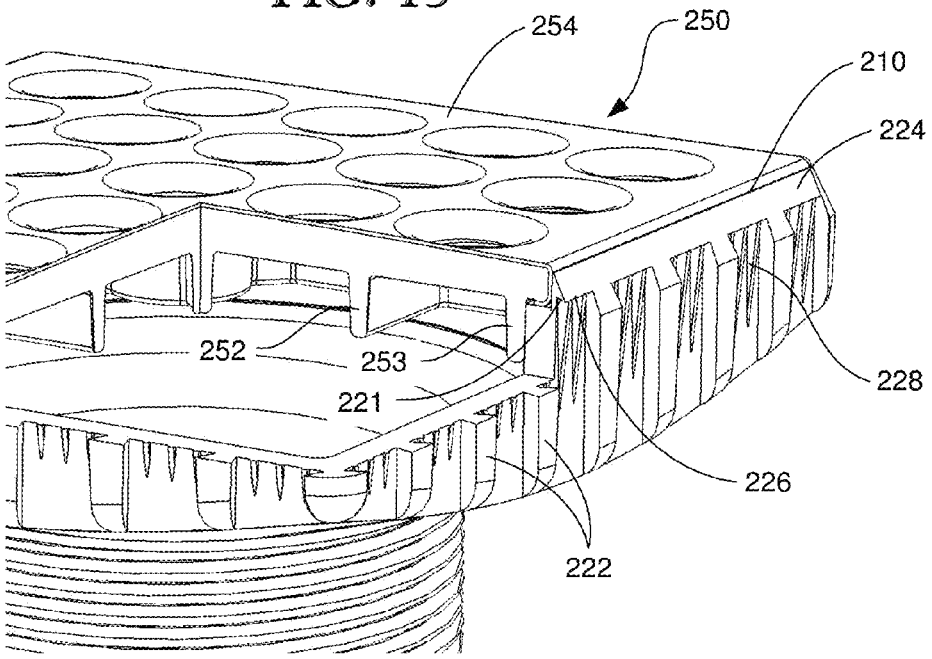
FIG. 16 is a partial cut-away perspective view of the drain body and drain grate of FIG. 15, showing the substructure of the drain grate and the dovetail and undercut rim features of the drain body.

Advantageously, the bowl beneath the grate is clean and clear of any ribs, posts, screw holes etc that can make it cluttered and difficult to maintain. The grate is supported only around it's perimeter by a narrow shelf 208. Just inside and below that shelf is a near-vertical surface 209 that extends down to the floor of the bowl 218. Against this surface an inner perimeter rib or wall (253 in FIGS. 16, 20) of the grate frame makes a light friction fit. Below the grate frame structure there is substantial vertical clearance (at least about another 0.2") above the bowl floor. As a result, the bowl is relatively deep (compared to the size of the grate openings). This helps create a shadow and a blacked-out effect that is very desirable, especially where the drain body is black or some other dark color. When viewed from the top through the openings in the grate, the visibility of any build-up of soap scum, scale and hair will be substantially reduced. The grate looks clean and beautiful and is not detracted by a view of scum build up just below the surface.

As with other embodiments discussed above, the knife edge grout rim 210 provides a sharp termination (e.g. from about 0.005" to about 0.015" width) at the top edge of the drain body 200, and becomes substantially hidden to the eye when embedded into the grout line which is formed to the level of the construction plug 240. When a drain grate is inserted into the inlet portion 202 and supported by the shoulder 208, friction between the vertical surface 209 and the perimeter rib 253 of the drain grate's polymer frame holds the grate in place. A small clearance is maintained between the clad portion of the grate and the grout rim 210 to allow for drainage immediately around the slightly elevated grate. The outer sides 220 of the inlet portion of the drain body include vertical buttresses 222 for added strength. The knife edge grout rim has an outer surface 224 that tapers to the upper edge (e.g. a 20 degree (relative to vertical) taper) for greater stability between the vertical buttresses.

Around the outer sides 220 of the inlet portion 202 of the drain body 200 are undercut grout locking features 220. The grout locking features of the embodiment shown in FIGS.

Figure 18:
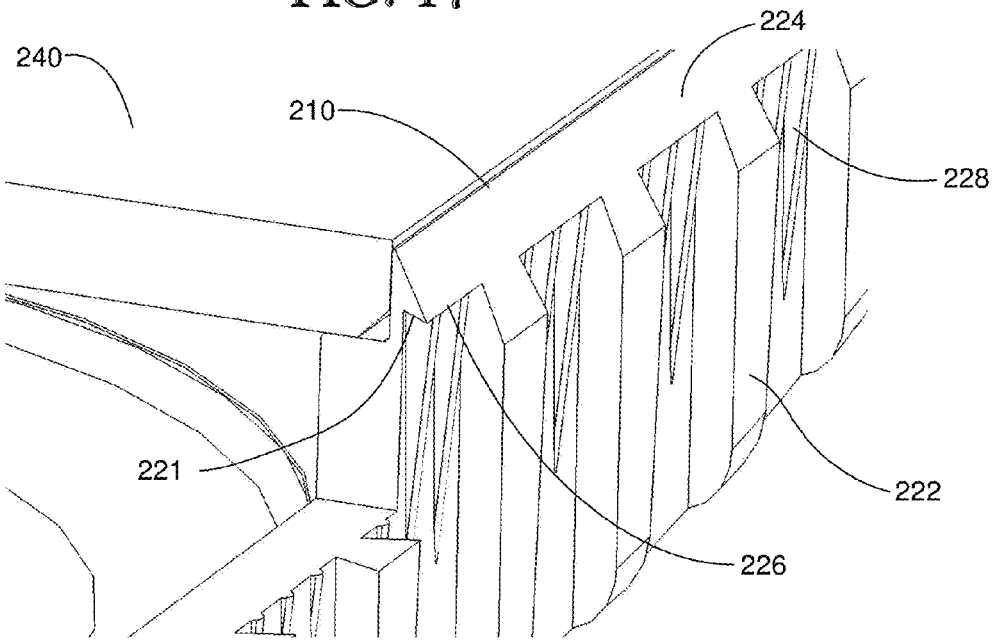
FIG. 18 is a close-up view of a portion of FIG. 17, showing the undercut rim, dovetail buttresses and sidewall darts.
Figure 19:
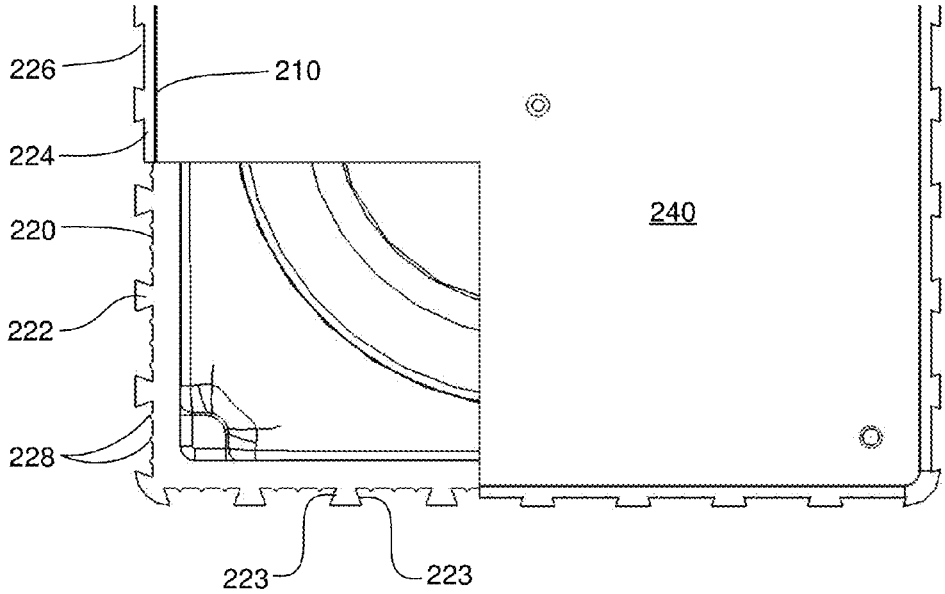
FIG. 19 is a partial cut-away sectional top view of the drain body and cover cap of FIG. 17, showing the cross-sectional shape of the darts and dovetail buttresses.
Figure 20:
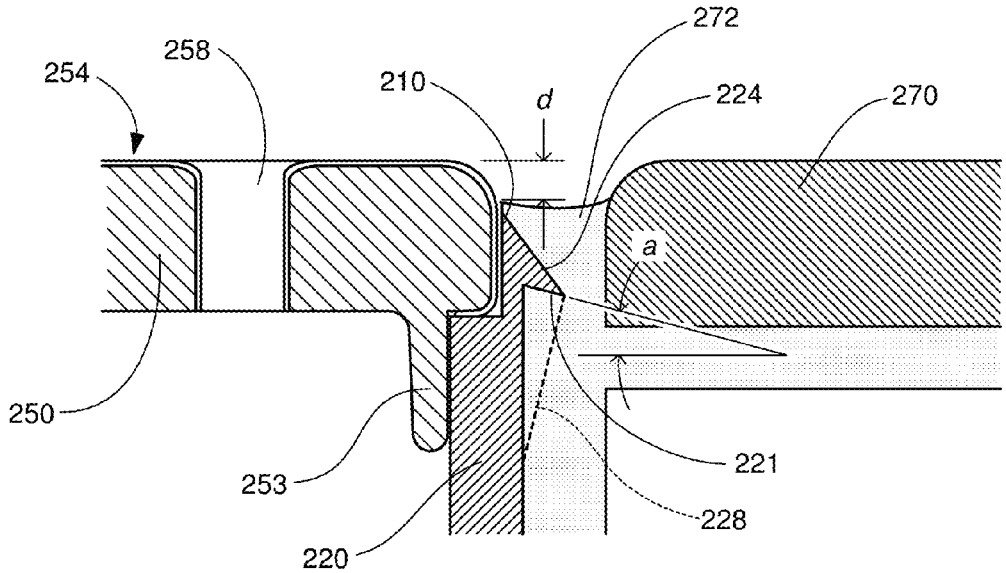
FIG. 20 is a side cross-sectional view of a portion of an embodiment of the drain body wall and grate, installed in a floor structure with adjacent tile and tile grout material.

11-14 are shown more clearly in FIGS. 15-19. FIGS. 15-20 do not show any new structure with respect to the grout locking features, but merely provide additional and more detailed views of the structure shown in FIGS. 11-14. One grout locking feature is a horizontal undercut edge 226, the shape of which is best viewed in the cross-sectional view of FIG. 12 and in FIGS. 16, 18 and 20. This horizontal undercut provides an undercut surface 221 that tapers upward toward the sidewall 220 of the drain body, thus providing a taper in an opposite direction from the taper of the outer surface 224 of the grout rim, to provide additional interlock with the grout. The undercut surface 221 is also shown in FIG. 20. The angle $\alpha$ of the undercut surface, as labeled specifically in FIG. 20, can vary. In one embodiment the undercut surface has an angle $\alpha$ of about 20° relative to the horizontal. Other angles can also be used. For example, the inventor believes that the undercut edge 226 can have and angle $\alpha$ of from about 15° to 30°. As for its length or size, the undercut edge 226 can extend about 0.10" to 0.25" from the sidewall of the drain body.

Figure 14:
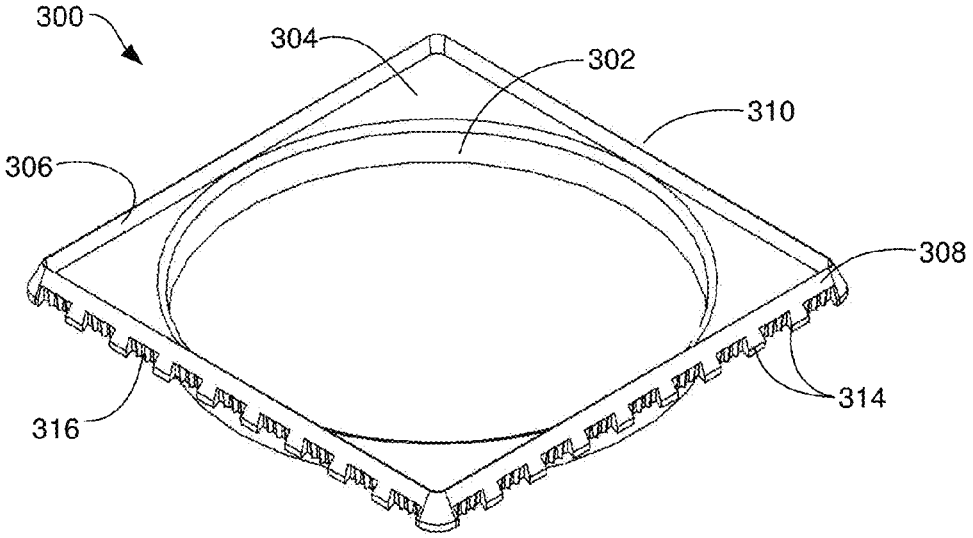
FIG. 14 is a perspective view of a thin-set tray that incorporates many features of the floor drain with knife edge in applications where a friction-fit grate is desired without using the drain body having the knife edge.
Figure 15:
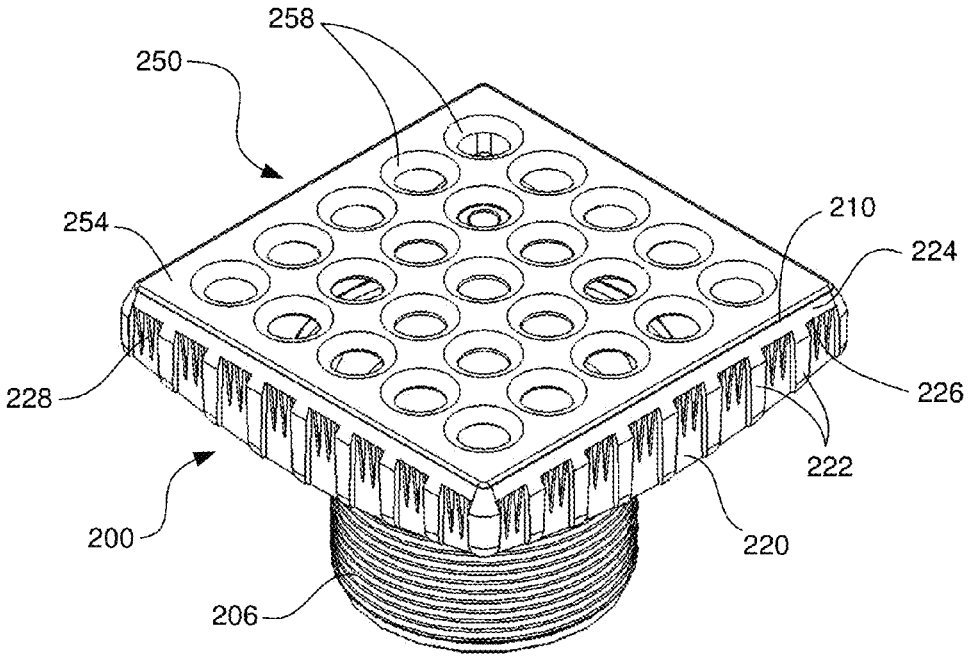
FIG. 15 is a perspective view of an embodiment of the drain body shown in FIGS. 11-12, with a metal-clad polymer drain grate like that of FIG. 13 inserted therein.

The grout locking features can also include tapered or dovetail surfaces associated with the buttresses 222, shown in FIGS. 11, 12 and 14, to cause the buttresses to interlock with surrounding grout, allowing the grout to capture the drain body and hold it in position in a dovetail arrangement. The cross-sectional dovetail shape of the buttresses 222 is shown most clearly in FIGS. 16-19. The buttresses have a dovetail shape that becomes wider as the buttress extends away from the sidewall 220 of the drain body. This provides dovetail surfaces 223 that are angled toward the drain body, so that a mechanical interlock is created with grout material that surrounds the drain body. Wet grout material can be forced between and around the dovetail buttresses, and when that material cures and hardens, it will provide a mechanical lock between the drain body wall and the hardened mass of grout material. Since the dovetail surfaces 223 of the buttresses are angled with respect to a vertical plane, and the angled undercut surface 221 of the undercut edge 226 is angled with respect to a horizontal plane, the undercut edge and the dovetail buttresses combine to anchor the drain body with respect to both vertical and horizontal movement.

The outer sides 220 of the drain body can also include vertical darts 228 below or along the horizontal undercut 226 to improve plastic flow to thin wall sections during the molding process, as well as to add rigidity. These darts are shown in FIGS. 11, 12 and 14, and also in close-up and sectional views in FIGS. 15-20. Given their angular faces, the darts also help provide additional anchorage of the drain body in the surrounding grout material, while their small size in relation to the buttresses does not weaken the anchoring grout material between the buttresses.

Figure 13:
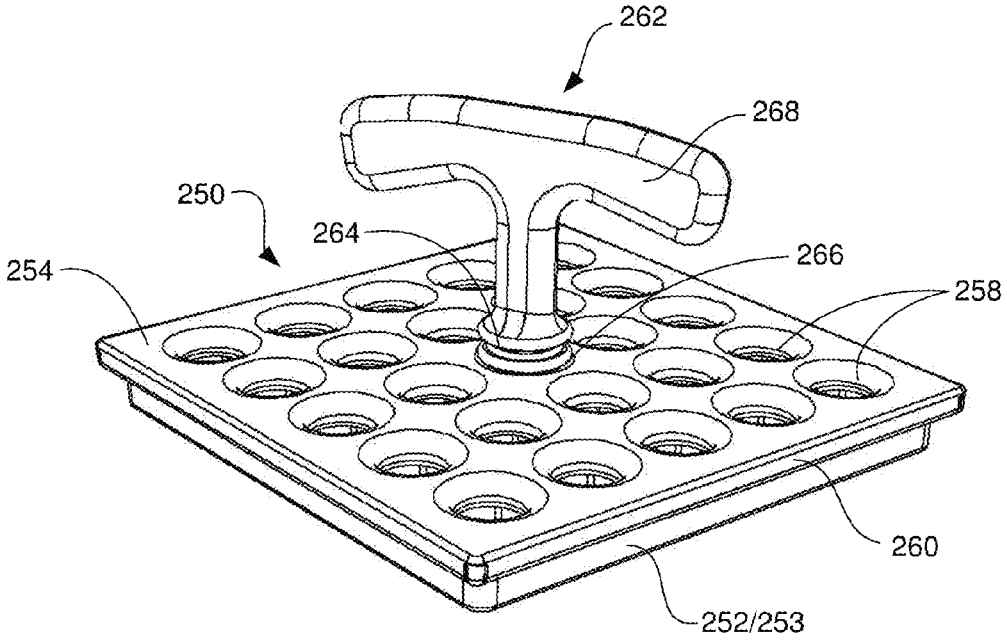
FIG. 13 is a perspective view of an embodiment of a metal-clad polymer drain grate and grate removal tool.

A solid metal drain grate (similar to that shown in FIG. 5) can be used with the drain body depicted in FIGS. 11 and 12. Such a drain grate can be substantially planar, without mounting posts like the mounting posts 44 in the drain grate 16 of FIG. 5. The inventor has also developed a metal-clad polymer drain grate 250, one embodiment of which is shown in FIG. 13. This drain grate comprises a polymer body 252 (e.g. injection molded) with a relatively thin gauge metal skin 254 that covers the top surface 256, the inner surfaces of the drain apertures 258, and the side edges 260 of the grate.

The metal skin 254 can be of stainless steel, aluminum, or other metals that are resistant to degradation in the presence of water. Advantageously, the thin metal skin can be pressed into the appropriate shape from sheet products, and then clenched onto the polymer grate body around the outer edges of the grate and through the drainage holes. The outer edges 260 of the grate can be rounded to protect the grate from damage if is it dropped or bumped, and also to eliminate sharp edges Likewise, the corners of the metal cladding can be cut away or relieved to remove sharp edges and to reduce the likelihood that the cladding could be snagged and pulled away from the polymer grate body. The height of the shoulder (208 in FIG. 11) and grout rim (210 in FIG. 11) can be selected so that the elevation of the drain grate surface is slightly above the top of the grout rim to help protect the grout rim from contact and damage, and to cast in shadow any potential view of the grout rim and to esthetically terminate with perimeter edges that round into the grout line. The polymer drain grate body can include integral ribs (252 and 253 in FIGS. 16, 20) and other support structure on its underside to give it greater strength. The metal-clad polymer frame is well suited to this application of rectangular grates. The resilient nature of the polymer frame allows the grate's structure to flex under heavy loading and immediately recover to its original shape. Less resilient perforated metal grates can tend to flex or sag under load, potentially causing the corners of the grate to rise and become a hazard. The metal-clad polymer grate design also reduces the cost and weight of the drain grate, while still substantially retaining the functional and aesthetic characteristics of heavier solid metal drain grates described above.

The drain grate 250 shown in FIG. 13 can be easily removed using a T-handle grate removal tool 262. This tool includes a twist-fit shank 264 that can engage into the center drain aperture 266. The user inserts the shank end into the center aperture, and twists the T-handle 268 to engage a shoulder thereon. Once the T-handle is engaged, a user can easily remove the drain grate 250 by pulling on the T-handle. The opposite procedure is used to insert the drain grate.

Figure 17:
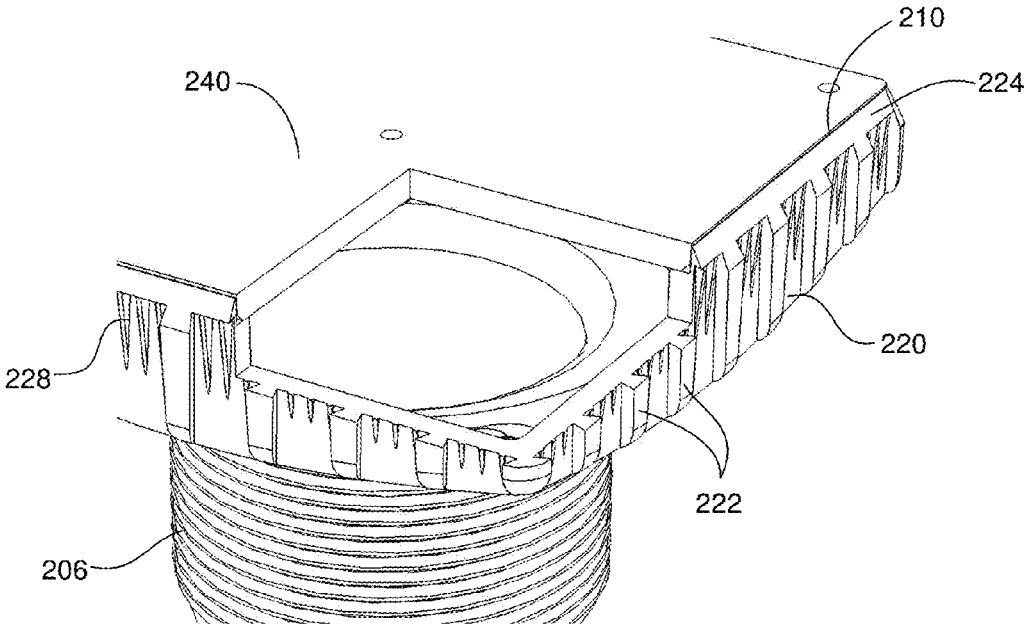
FIG. 17 is a partial cut-away perspective view of the drain body of FIG. 15, having a cover cap or blank inserted in the drain opening.

The drain body 200 depicted in FIGS. 11 and 12 can be installed using a plug similar to the plug 116 shown in FIG. 10. A plug 240 installed in this drain body embodiment is shown in FIGS. 17-19. The plug has a generally continuous upper surface (140 in FIG. 10) and is inserted into the inlet 202 in the same manner as a drain grate. This plug remains in place during grouting and until the grout has hardened, and is able to stabilize the knife edge rim 210 of the drain body as well as the four vertical perimeter edges 209 below, against which a close fit to the grate will be preserved. The plug serves as a fixture to establish squareness and insure that a minimal and uniform clearance is maintained around the drain grate by eliminating any tendency for distortion during grouting. This clearance between the edge 260 of the drain grate and the grout rim 210 is shown most clearly in FIG. 20. The plug 240 is slightly thicker than the height of the grout rim surrounding it. With the plug in position its top surface is the surface to which the grout is formed. This serves to totally embed the grout rim into the grout. When the grout has cured the plug is removed.

Referring to FIG. 10, the plug 116 can include one or more small tapered screw start holes 146 on its top surface 140. In the embodiment shown in FIG. 10, the plug includes one screw start hole 146 in each of its four corners, and one in the center. Once the grout has hardened sufficiently, the plug can be removed by driving a screw (not shown) into one or more of the screw start holes on the plug. A common grabber screw can be started into one or more of the holes just enough to grip the plug so that it can be extracted by pulling the screw by hand or using the claw of a hammer or some other tool to remove the plug from the drain body.

Shown in FIG. 14 is a thin-set tray 300 that can be used to interconnect a rectangular drain grate with a conventional circular drain opening. This thin-set tray provides a drain body having many of the same general parts as the drain body 200 shown in FIG. 11, but with a thinner profile. The thin-set tray 300 comprises a drain body having a circular lower outlet portion 302 that is configured to mate with a circular opening of a drain structure. The upper portion of the tray includes a rectangular shelf 304 that is configured to support a rectangular drain grate, like those discussed above. Surrounding the shelf is an integral grout rim 306 that has an outer tapered surface 308 that tapers to a sharp top edge 310. The outer perimeter of the thin-set tray includes grout locking features similar to those associated with the drain body of FIG. 11. These can include buttresses 314 and darts 316 that have tapered surfaces to help create a dovetail configuration to interlock the tray into the surrounding grout.

The thin-set tray 300 provides an alternative design of a drain body that incorporates many of the features of the drain body of FIG. 11, discussed above, for applications where an attractive rectangular grate is desired like those disclosed herein, but a drain body having greater thickness like that disclosed herein is not being used, or a different drain structure is already in place. For example, such circumstances can arise where a drain fitting is provided pre-installed into a shower floor assembly, or where a new layer of tile is to be installed over an existing tile floor. In such cases the thin-set tray can be installed like a piece of tile to directly overlie a common round drain inlet, providing the aesthetic advantages of the floor drain of this disclosure with a thinner profile drain body. The thin-set tray embodiment can also be used to provide small adjustments to the angle and position of the grate.

This invention provides several advantages. It provides a drain device that is easier to match with tile because it has straight sides (i.e. no curved cutting required), and matches more easily to the generally planar slope segments of a typical shower floor. Since the drain body and grout rim has square corners, tile can be cut to fit using saw cuts alone, with no grinding required (e.g. to form a rounded or curved corner). The knife-edge metal rim practically disappears, providing a more pleasing appearance than thick metal or plastic rims of typical round grates. Additionally, because the grate is not attached with fasteners, it can be easily removed for protection from harsh cleansers or clog clearing chemicals. This allows a variety of more delicate materials to be used for the grate, and also allows easy replacement of the grate for decorative reasons.

By way of example, and without limitation, the invention can be described as a floor drain, including a drain body, a generally rectangular drain grate supported by the drain body and having a plurality of drain openings, and a grout rim supported by the drain body and surrounding the drain grate. The drain body includes a generally rectangular upper portion defining an inlet aperture, and a circular lower portion defining an outlet in fluid communication with the inlet aperture, the lower portion being configured to interconnect to an underdrain structure. The grout rim has an outside surface having interlocking structure configured to interlock with surrounding materials, and a sharply tapered top edge, configured to reduce the visibility of the grout rim between the surrounding material and the grate.

As another example, the invention can be described as a floor drain, including a drain body, a generally rectangular drain grate supported by the drain body, and a grout rim supported by the drain body and surrounding the drain grate. The drain body includes a generally rectangular upper portion defining an inlet aperture, and a circular lower portion defining an outlet in fluid communication with the inlet aperture, the lower portion being configured to interconnect to an underdrain structure. The drain grate includes a plurality of drain openings and a plurality of downwardly oriented mounting posts configured to insert into receiving holes in the drain body, whereby the drain grate is removably secured to the drain body.

As yet another example, the invention can be described as a floor drain assembly, including a drain body having an outlet, a generally rectangular drain grate supported by the drain body and having a plurality of drain openings, a grout rim supported by the drain body and surrounding the drain grate, and an underdrain inlet attached to the outlet of the drain body. The drain body includes a generally rectangular upper portion defining an inlet aperture, and a circular lower portion defining an outlet in fluid communication with the inlet aperture, the lower portion having helical threads configured to threadedly interconnect with corresponding helical threads of an underdrain structure, whereby a height of the inlet can be adjusted by rotating the drain body about a central axis.

Another feature of the floor drain system disclosed herein is shown in FIG. 20. The distance from the shoulder 208 that supports the drain grate 250 to the sharp top edge of the grout rim 210 can be less than the total thickness of the drain grate 250. This difference in thickness can allow the knife edge of the grout rim 210 to be some distance d below the top surface of the grate when the grate is installed, providing a vertical lip immediately adjacent to the edge of the drain grate. The size of this vertical lip can vary. As shown in FIG. 20, the top of knife edge of the grout rim can land just below the radius of the edge of the grate. In one embodiment, this distance is 0.015", but it is believed that distances of 0.01" to 0.05" can be used.

This configuration provides a hidden pocket for the grate 250, so that the edge of the grout rim 210 becomes even less visible. The top of the grate is substantially flush or level with the top of an adjacent tile 270, but is not flush with the grout 272. Because of this configuration, the grout rim falls within a shadow region next to the grate edge. This further hides the grout rim, thereby contributing to the aesthetic appearance of the floor drain installation.

Figure 21:
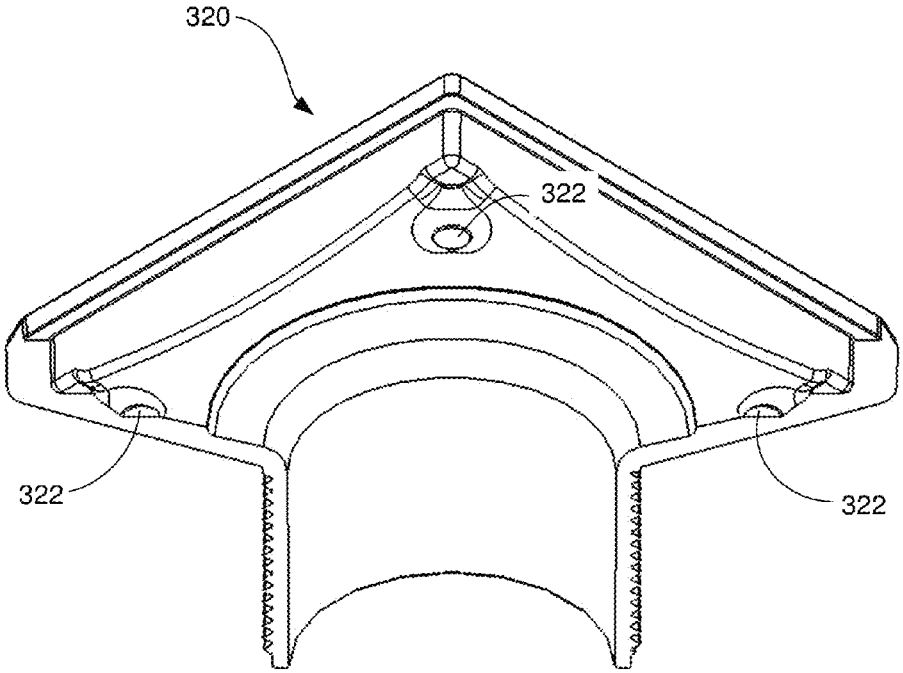
FIG. 21 is a 45 degree cross-sectional view of an embodiment of a drain body having corner lands for supporting set screws for adjusting a height of a drain grate.

Another embodiment of a floor drain body having an additional feature is shown in the cross-sectional view of FIG. 21. Here an embodiment of a drain body 320 is shown having flat, circular lands 322 in the interior near the corners 324 of bowl floor of the drain body. These flat spots can be positioned below a location of threaded holes in a drain grate (not shown). Extraction of the grate can be made by inserting and rotating two threaded handle in the threaded holes in opposite corners of the grate, causing the threaded handles to push against the flat spots or lands to lift and extract the grate. This embodiment may prove to be more effective in removing a grate than a single center puller if a grate becomes bonded in place by mineral and soap deposits It is to be understood that the above-referenced arrangements are only illustrative of the application of the principles of the present invention in one or more particular applications. Numerous modifications and alternative arrangements in form, usage and details of implementation can be devised without the exercise of inventive faculty, and without departing from the principles, concepts, and scope of the invention as disclosed herein. Accordingly, it is not intended that the invention be limited, except as set forth in the claims.

What is claimed is:

1. A floor drain system, comprising:

a generally rectangular drain grate having a plurality of drain apertures; and a drain body, having a circular lower portion defining an outlet and configured to mate with an underdrain structure, and an upper portion defining an inlet, configured to receive the drain grate in a frictional fit, the drain body including an integral grout rim surrounding the inlet, having a knife-tapered top edge, and further including an undercut rim around an outer perimeter of the inlet, the undercut rim having a bottom surface angled radially outward and downwardly from the drain body.

2. A floor drain system in accordance with claim 1, wherein the lower portion includes helical threads configured to threadedly interconnect with the underdrain structure, whereby a height of the inlet can be adjusted by rotating the drain body about a vertical axis.

3. A floor drain system in accordance with claim 1, wherein the drain grate is selected from the group consisting of a solid metal grate, and a metal-clad polymer grate.

4. A floor drain system in accordance with claim 1, wherein the drain body comprises a thin-set tray, configured to overlie a circular drain structure therebeneath, and including undercut grout locking features disposed on an outer perimeter of the upper portion, configured to mechanically interlock the drain body with surrounding grout material.

5. A floor drain system in accordance with claim 1, wherein the bottom surface of the undercut rim has an upward angle of about 20 degrees.

6. A floor drain system in accordance with claim 1, further comprising substantially vertically oriented dovetail-shaped buttresses extending outward from the drain body, having upright tapered surfaces angled toward the drain body, thereby to mechanically interlock the drain body with hardened grout therearound.

7. A floor drain system in accordance with claim 1, wherein the knife-tapered top edge of the grout rim has a top edge with a minimum thickness of from about from about 0.015" to about 0.005".

8. A floor drain system in accordance with claim 1, further comprising a plug, configured to removably fit into the inlet to support the drain body and the grout rim during installation of the floor drain.

9. A floor drain system in accordance with claim 1, further comprising a handle, configured to rotationally interlock with a selected aperture of the drain grate, to allow removal of the grate from the drain body.

10. A floor drain system in accordance with claim 1, further comprising a substantially flat land in an interior of the drain body, the flat land being positioned below a location of a threaded hole in a drain grate, whereby extraction of the grate can be made by inserting and rotating a threaded handle in the threaded holes in opposite corners of the grate, and causing the threaded handles to push against the flat spots or lands to lift and extract the grate.

11. A floor drain, comprising:

a height-adjustable drain body, having a circular lower portion defining an outlet, the lower portion being configured to interconnect to an underdrain structure, and a generally rectangular upper portion defining an inlet, the upper portion including an integral grout rim surrounding the inlet and having a knife-tapered top edge, and further including an undercut rim around an outer perimeter of the inlet, the undercut rim having a bottom surface angled radially outward and downwardly from the drain body, and dovetail-shaped buttresses extending outward from the drain body, having tapered surfaces angled toward the drain body, thereby to mechanically interlock the drain body with hardened grout there around; and a generally rectangular drain grate, supported by the drain body, having a plurality of drain openings, configured to insert into the inlet with an interference fit, whereby the drain grate is removably secured to the drain body.

12. A floor drain in accordance with claim 11, wherein the drain grate is selected from the group consisting of a solid metal grate, and a metal-clad polymer grate.

13. A floor drain in accordance with claim 11, wherein the grout rim includes a knife-tapered top edge with a minimum thickness of from about from about 0.015" to about 0.005" and an outer face having a taper of about 20° relative to vertical.

14. A floor drain in accordance with claim 11, further comprising a plug, configured to removably fit into the inlet to support the drain body and the grout rim during installation of the floor drain.

15. A floor drain assembly, comprising:

a drain body, having a generally rectangular upper portion defining an inlet aperture, and a circular lower portion defining an outlet in fluid communication with the inlet aperture, the lower portion having helical threads configured to threadedly interconnect with an underdrain, whereby a height of the inlet can be adjusted by rotating the drain body about a central axis, and the upper portion including an integral grout rim surrounding the inlet and having a knife-tapered top edge, and further including an undercut rim around an outer perimeter of the inlet, the undercut rim having a bottom surface angled radially outward and downwardly from the drain body, and dovetail-shaped buttresses extending outward from the drain body, having tapered surfaces angled toward the drain body, thereby to mechanically interlock the drain body with hardened grout there around;

a generally rectangular drain grate, having a plurality of drain openings, surrounded by the grout rim and supported by the drain body; and an underdrain attached to the outlet of the drain body.

16. A floor drain in accordance with claim 15, wherein the bottom surface of the undercut rim has an angel of about 20 degrees relative to horizontal.

17. A floor drain in accordance with claim 15, wherein the knife-tapered top edge of the grout rim has a top edge with a minimum thickness of from about 0.015" to about 0.005".

18. A floor drain in accordance with claim 15, wherein the drain grate is selected from the group consisting of a solid metal grate, and a metal-clad polymer grate.

19. A floor drain in accordance with claim 15, further comprising a T-handle grate removal tool, configured to insert through a selected opening in the drain grate, to facilitate removal of the drain grate from the drain body.

* * * * *